US005711625A

United States Patent [19]

Takahashi

[11] Patent Number: 5,711,625

[45] Date of Patent: Jan. 27, 1998

[54] PRINTER AND RECORDING START CONTROL METHOD FOR THE SAME

[75] Inventor: Hiromitsu Takahashi, Iwate-ken, Japan

[73] Assignee: AlpsElectric Co., Ltd., Tokyo, Japan

[21] Appl. No.: 699,596

[22] Filed: Aug. 19, 1996

[30] Foreign Application Priority Data

Aug. 23, 1995 [JP] Japan ..... 7-214988

[51] Int. Cl.[6] ..... B41J 13/10

[52] U.S. Cl. ..... 400/582; 400/120.01; 400/622

[58] Field of Search ..... 400/120.01, 120.02, 400/582, 622

[56] References Cited

U.S. PATENT DOCUMENTS

| | | | |
|---|---|---|---|
| 4,552,470 | 11/1985 | Yana et al. | 400/120.02 |
| 5,072,244 | 12/1991 | Aoki et al. | 346/140 |
| 5,315,322 | 5/1994 | Bannai | 346/108 |
| 5,452,073 | 9/1995 | Kataoka | 355/271 |

*Primary Examiner*—John S. Hilten
*Attorney, Agent, or Firm*—Guy W. Shoup

[57] ABSTRACT

It is intended to provide a printer of a low cost capable of correcting a minute recording dislocation in one step, as well as a recording start control method for the printer. The printer in which a recording medium holding mechanism is driven intermittently one rotation at a time by means of a drive motor and recording is made plural times in one position of a recording medium on the recording medium holding mechanism by means of a recording head, comprises: a sensor which outputs a detection signal when the recording medium holding mechanism has reached a predetermined rotational position; position control means which stops the operation of the drive motor in response to the detection signal provided from the sensor and places the recording medium on the recording medium holding mechanism in a recording start position; and recording start control means which detects as recording start correction data the time required from the detection signal is outputted from the sensor until when the drive motor stops completely and which controls the start timing of recording.

4 Claims, 7 Drawing Sheets

PRINTER AND RECORDING START CONTROL METHOD FOR THE SAME

BACKGROUND OF THE INVENTION

1. Field of the Invention

The present invention relates to a printer and a recording start control method for the printer. Particularly, the invention is concerned with a printer constructed in such a manner that recorded information is obtained by overlapping inks plural times on a recording medium, as well as a recording start control method for the printer.

2. Description of the Related Art

In a conventional printer constructed so as to obtain a desired recording by overlapping inks of plural colors (even a dingle color will do) on a recording medium, a sensor as position control means is disposed for specifying an initial recording position as the foremost position in a recordable range of a recording medium, and control is made so as not to displace the initial recording position of each ink.

The construction of the conventional printer of this type and the recording start control method for the printer will be explained below briefly while giving an example.

In the conventional printer, a platen roller is disposed rotatably, the platen roller comprising a metallic cylinder and a rubber material as an intermediate transfer member coated on the surface of the metallic cylinder, with a thermal head disposed near the platen roller. The thermal head has a plurality of heating elements arranged linearly in opposed relation to the central part of the platen roller. On both sides of the thermal head are disposed a pair of ribbon rolls for guiding an ink ribbon nearly linearly between the platen roller and the thermal head.

In a diametrically symmetric position with respect to the thermal head of the platen roller is disposed a drum which is brought into strong pressure contact with the platen roller and which can be rotated by means of a stepping motor. On the surface of the drum is formed a clamper for clamping one end portion of a predetermined recording sheet of paper, e.g. ordinary paper. Also disposed on the drum is a detection plate for being detected by a sensor disposed near the drum to thereby control on-off of the drum rotation. The sensor and the detection plate constitute position control means.

The ink ribbon used in this conventional example is a color ribbon having inks of four colors, yellow (Y), magenta (M), cyan (C) and black (Bk), which are applied repeatedly in the longitudinal direction.

The recording in this conventional printer is performed in the order of Y→M→C→Bk and therefore the ink ribbon is taken up so that the head position of the ink color Y first assumes the position opposed to the recording head. Discrimination among colors of the ink ribbon is performed while recognizing a marker printed between adjacent ink ribbon colors by means of a photosensor or the like.

Next, the drum is rotated while the recording paper is grasped with the clamper on the drum, allowing the recording paper to be wound around the drum. At the same time, the detection plate is detected by the sensor to specify a recording start position, and the rotation of the drum is stopped temporarily. Then, the drum is brought into strong pressure contact with the platen roller. In this state the ink ribbon is allowed to advance at a constant speed, being taken up around the ribbon roll, and the heating elements of the thermal head are each caused to produce heat in accordance with a desired recording signal. The ink of the ink ribbon is melted partially by selective heat generation from the heating elements of the thermal head and is transferred onto the surface of the platen roller. Such a primary recording image thus formed on the surface of the intermediate transfer member is retransferred onto the fed recording paper by virtue of the pressure contact force of the drum.

After the ink Y has been retransferred onto the recording paper, the ink ribbon is conveyed up to the head position of the next ink M. Then, a recording start position for recording the ink M overlappedly on the recording of the ink Y is specified again by the sensor.

In this way the recording start position is specified by both sensor and detection plate at every recording with each color ink, followed by pressure contact between the intermediate transfer roller and the thermal head and that between the intermediate transfer roller and the drum to effect recording (retransfer) and subsequent release of each such pressure contact. These steps are repeated to obtain desired recorded information.

In the recorded information thus obtained there sometimes occurs a recording dislocation in the rotating direction of the drum.

As reasons for such recording dislocation are presumed inappropriateness in the number of steps relating to the function of the stepping motor and in the precision ratio of a reduction mechanism for the motor driving force. According to the position control means using the foregoing sensor, however, it has been impossible to correct the recording dislocation more accurately than the resolution in the drum rotating direction (hereinafter referred to as the "vertical scanning direction") attained by both the recording medium driving motor and the reduction mechanism.

Further, for improving the resolution to correct the recording dislocation it has heretofore been necessary to change the stepping motor into one having a larger number of steps and a higher resolution or increase the motor speed and so significantly decrease the reduction ratio. However, both of such measures involve the problem that the cost is increased.

SUMMARY OF THE INVENTION

The present invention has been accomplished in view of the above-mentioned problems and it is an object of the invention to provide a printer of a low cost and capable of correcting a minute recording dislocation within one step, as well as a recording start control method for the printer.

In order to achieve the above object and according to one aspect of the present invention, there is provided a printer having recording start control means for controlling the operation timing of a recording head on the basis of recording start correction data which are obtained from data detected by position control means, the position control means functioning to specify a recording start position of the printer.

A recording start control method for the printer according to another aspect of the present invention detects the time required from when a sensor as the position control means for specifying a recording start position senses the arrival of a recording medium holding mechanism at a predetermined rotational position until when a drive motor of a recording medium conveying mechanism stops completely, stores the detected data as recording start correction data in the recording start control means, and, at the time of actual recording, controls the operation timing of the recording head according to the recording start correction data.

The above printer and recording start control method for the printer bring about the effect that the recording start position in a single recording process can be constantly corrected by controlling the operation timing of the recording head.

According to a first modification of the printer, a thermal head is used as the recording head. By using this printer, the time required from when the sensor as the position control means for specifying a recording start position detects a detection plate until when the drive motor of the recording medium conveying mechanism stops completely is detected and the detected data obtained is stored as correction data in the recording start control means, whereby at the time of actual recording the heat generation timing of each heating element in the thermal head can be controlled in accordance with the recording start correction data and hence it is possible to obtain good recorded information free of recording dislocation.

According to a second modification of the printer, the recording start control means comprises a sensor control section for controlling the sensor to detect recording start correction data, a data storage section for storing the data detected by the sensor control section as recording start correction data, and a recording start control section for controlling the operation timing of the recording head on the basis of the recording start correction data. Thus, by making detection or management of recording correction data in each control section or storage section it is possible to obtain appropriate correction data at every recording, and by making a change in software of the recording start control means it is possible to obtain desired recorded information.

According to a third modification of the printer, there is further provided a detection plate to be detected by the sensor. By detecting this detection plate it is possible to detect that the recording medium holding mechanism has reached a predetermined rotational position.

According to a fourth modification of the printer, the recording start control means produces an interrupt signal at predetermined time intervals during the period after detection of the detection plate by the sensor until when the drive motor stops completely. According to this printer, by using the detected data obtained from the number of interrupt signals generated as correction data for the start of recording and by shifting the operation timing of the recording head it is possible to obtain a good recording result free of recording dislocation.

According to a fifth modification of the printer, in the printer of the third modification, a detection portion of the detection plate is formed into comb-like slits. According to this printer, by using the detected data obtained from how many comb-like slits the sensor has detected the sensor has detected as correction data for the start of recording and by shifting the operation timing of the recording head it is possible to obtain a satisfactory result of recording free of recording dislocation.

DESCRIPTION OF THE PREFERRED EMBODIMENTS

Intermediate transfer type printers according to the present invention will be described hereinunder with reference to FIGS. 1 to 8.

Figure 1:
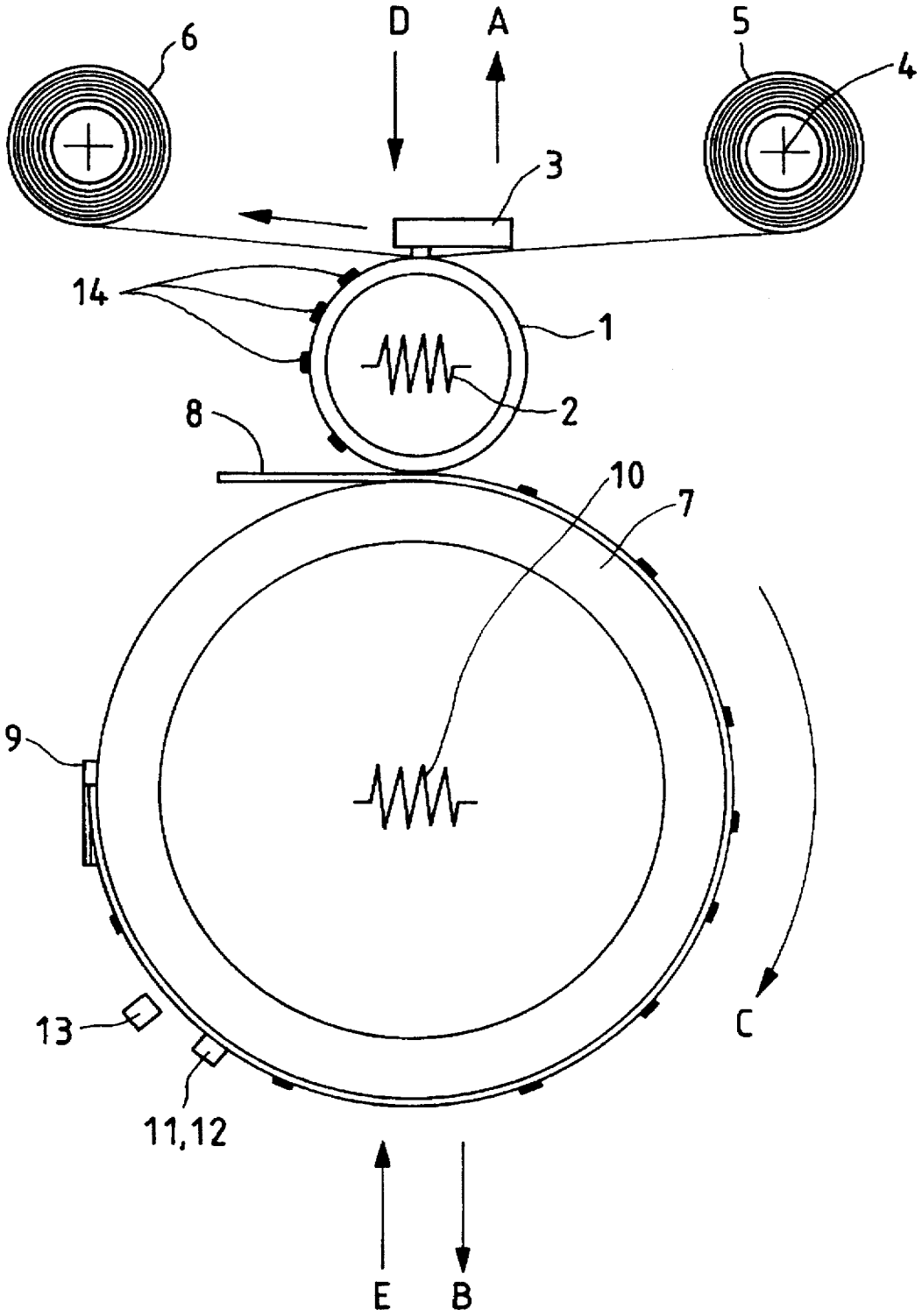
FIG. 1 is a sectional view showing a partial construction of a printer according to a first embodiment of the present invention.

FIG. 1 is a sectional view showing a partial construction of a printer according to a first embodiment of the present invention.

In the thermal transfer printer of this embodiment, a cylindrical intermediate transfer roller 1 is disposed rotatably and inside the roller 1 is disposed a heater 2 for heating the roller 1 to a predetermined temperature. The intermediate transfer roller 1 comprises a cylindrical core metal and silicone rubber as a rubber material (not shown) coated on the surface of the core metal, and thereby functions also as a platen roller. The silicone rubber surface of the roller 1 is coated with an intermediate transfer material (not shown) having adherence. Connected to the roller 1 is a drive unit (not shown) such as a motor.

It is desirable for the intermediate transfer roller 1 to have a diameter of 20 mm or more from the standpoint of ensuring its rigidity. But it is possible to make the roller 1 smaller in size if only its rigidity is ensured by the material of the core metal. In this embodiment the core metal has an outside diameter of 31 mm and an inside diameter of 28 mm, with the core metal material being plated with carbon steel Ni. The thickness of the silicone rubber applied to the core metal surface of the intermediate transfer roller 1 in this embodiment is set to 0.5 mm, and the foregoing intermediate transfer material laminated to the silicone rubber surface comprises a silicone of different components from the silicone rubber applied to the core metal surface, with the thickness of its layer being set at 150 μm.

As the heater 2 in this embodiment there is used a halogen lamp of 500 W. There may be used any other heater than such a halogen lamp provided it can produce heat in an amount capable of maintaining a melted or softened state of ink-ribbon ink transferred to the surface of the intermediate transfer roller 1, e.g. a cartridge heater.

Near the intermediate transfer roller 1 is disposed a thermal head 3. The thermal head 3 is a 200 to 600 dpi line head having a plurality of heating elements arranged linearly in opposed relation to the central part of the roller 1. It has a width of 75 to 300 mm. The thermal head 3 used in this embodiment is a 300 dpi line head having a width of 220 mm and having a 2560 dot configuration.

On both sides of the thermal head 3 are disposed a pair of ribbon rolls 6, 6 for guiding an ink ribbon 5 wound round a bobbin 4 in a substantially linear form to between the intermediate transfer roller 1 and the thermal head 3. As the ink ribbon 5 is used one having the same construction as that of the commonly-used ink ribbon for thermal transfer. According to the ink ribbon 5 used in this embodiment, a 3.5 μm PET film is used as a base film and a two-ink layer construction is adopted, the lower layer being a 1 μm thick WAX layer serving as a release layer and the upper layer being a 1 μm thick resin layer serving as an ink layer.

In a position diametrically symmetric to the thermal head 3 through the intermediate transfer roller 1 is disposed a cylindrical drum 7 rotatably as a recording medium holding mechanism, the drum 7 being brought into strong pressure contact with the roller 1. Also to the drum 7 is connected a stepping motor (not shown) as a drive unit.

Figure 2A:
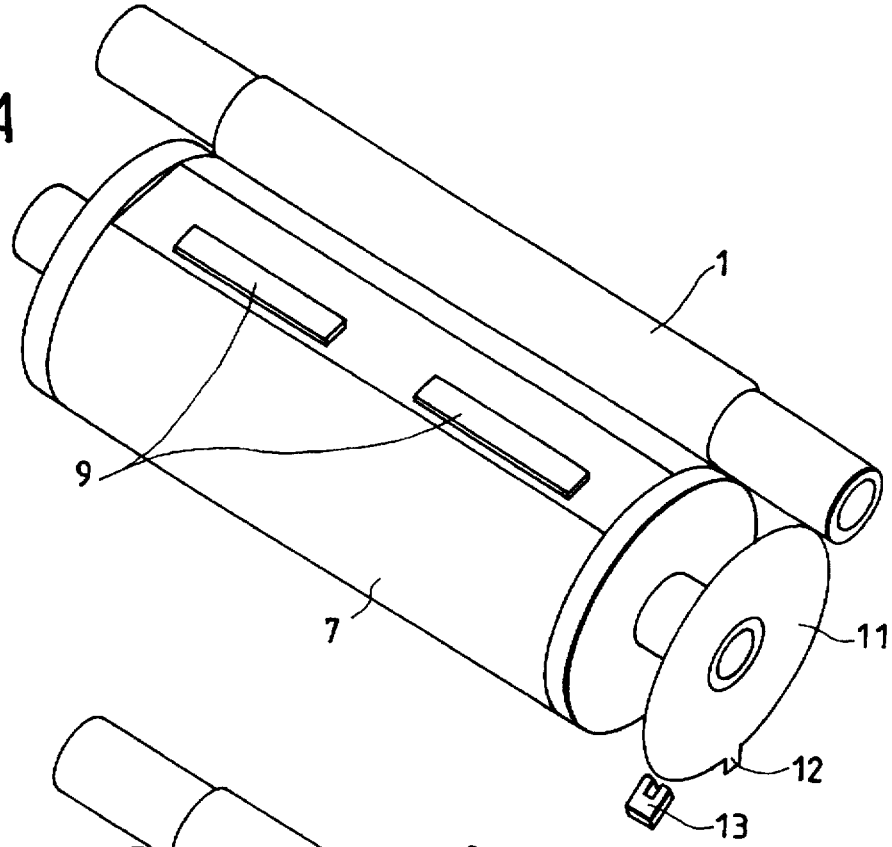
FIG. 2A is an explanatory diagram showing a positional relation between an intermediate transfer roller and a drum and that between a detection plate and a sensor in the printer of the first embodiment.
Figure 2B:
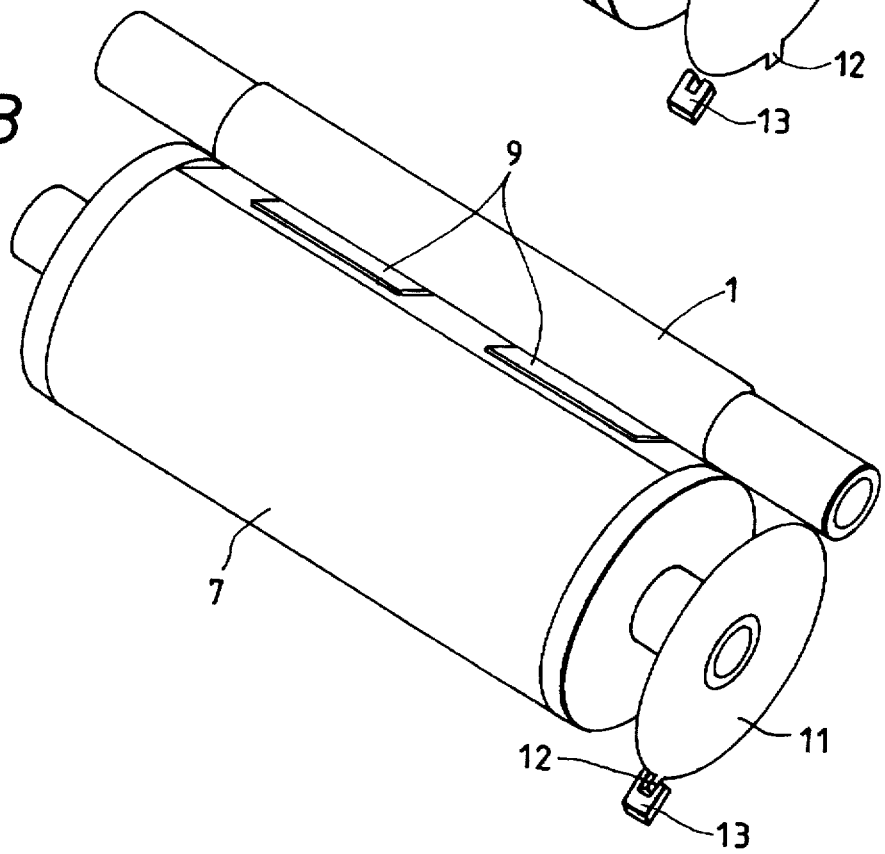
FIG. 2B is an explanatory diagram showing a positional relation between the detection plate and the sensor with the drum stopped in a recording start position in the printer of the first embodiment.

The drum 7 has a sufficient outer peripheral length for winding thereon of a sheet of recording paper 8 as a recording medium. On the surface of the drum 7 are disposed clampers 9 in the extending direction of the drum 7 for clamping one end of the recording paper 8 and fixing it to the drum 7. In this embodiment, since the size of the recording paper 8 wound around the drum 7 is A4 size, or the letter size, the diameter of the drum 7 was set at 100 mm to have the drum outer periphery length ensuring both paper length (about 300 mm) and mounting space (about 14 mm) of the clampers 9. To one side in the extending direction of the drum 7 is attached a generally disc-like detection plate 11 adapted to rotate coaxially with the drum 7, as shown in FIGS. 2A and 2B. Integral with the outer periphery of the detection plate 11 is a detection piece 12 of a square shape projecting outwards in the diametrical direction.

Figure 3:
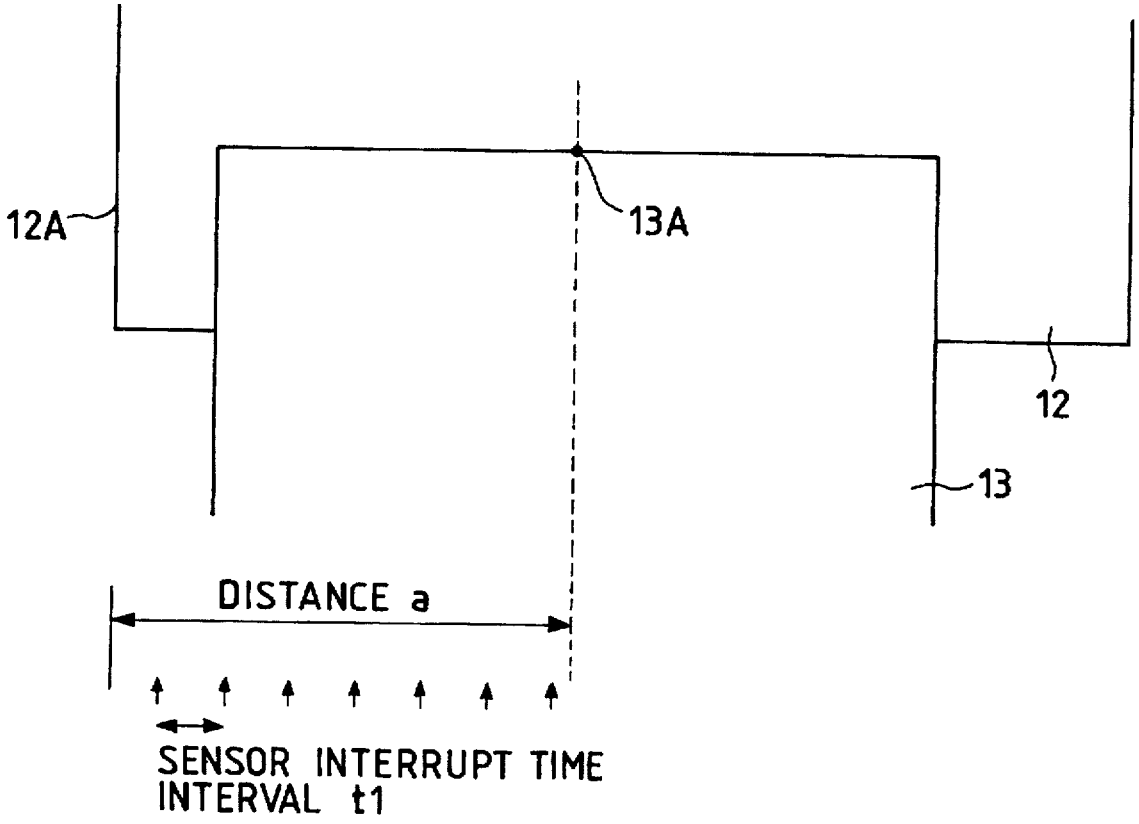
FIG. 3 is an explanatory diagram showing a positional relation between the sensor and a detection piece at the time of detection of correction data in the first embodiment.
Figure 4:
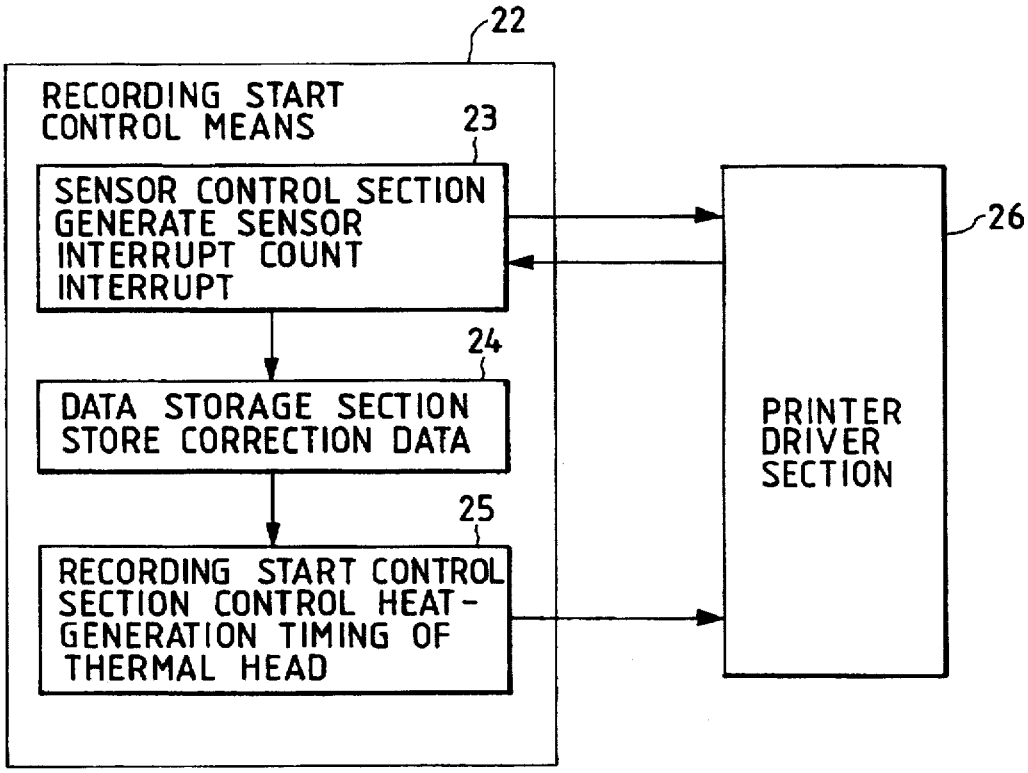
FIG. 4 is a diagram explaining the configuration of recording start control means.

On the other hand, a sensor 13 for detecting the detection piece 12 in an on-off manner is fixed to a housing (e.g. the printer body case) (not shown) of the drum 7. At the front end portion of the sensor 13, a central part in the width direction thereof is used as a sensor detecting position 13A, as shown in FIG. 3.

Inside the drum 7 is disposed a heater 10 for heating the drum 7 to a predetermined temperature. Although in this embodiment there is used a halogen lamp of 1 kW as the heater 10, there may be used any other heater provided it can produce heat in an amount capable of heating the recording paper 8 wound on the drum 7, retaining the heated temperature and improving the retransfer performance of ink to the recording paper.

The recording paper 8 may be the commonly-used recording paper, and even the film for an overhead projector (OHP) may be used.

The printer of this embodiment is provided with recording start control means 22 for controlling the recording start timing in the printer separately from a printer drive section 26 having the thermal head 3 and the drive motor.

The recording start control section 22 comprises a sensor control section 23 for controlling the sensor to prepare recording start correction data, a data storage section 24 for storing the data detected by the sensor control section 23 as recording start correction data, and a recording start control section 25 for controlling the operation timing of the thermal head 3 as the recording head on the basis of the recording start correction data.

The following description is now provided about a recording process until stop of the drum 7 in the recording start position and assuming a stand-by state for recording operation.

In the initial state, the thermal head 3 stands by in the arrow A direction, and the thermal head 3 and the ink ribbon 5 are spaced from each other. The ink ribbon 5 and the intermediate transfer roller 1 are also in a spaced relation to each other. Further, the roller 1 and the drum 7 are in a mutually spaced state, the drum being in a stand-by state spaced away in the arrow B direction.

Upon application of power to energize the heaters 2 and 10, heating is started for the intermediate transfer roller 1 and the drum 7. Also to the thermal head 3 are applied predetermined pulses intermittently to raise the temperature of the thermal head heating elements selectively.

As to the temperature of each heating element, though not shown in FIG. 1, control is made so as to make heating up to a predetermined temperature and maintain the thus-raised temperature while sensing the temperature by means of, for example, a thermistor or an infrared radiation temperature sensor.

The temperature control is made so that all of the thermal head 3, the intermediate transfer roller 1 and the drum 7 have the same temperature in the range from 40° C. to 70° C., preferably 50° C. to 60° C. In this embodiment control is made so that all the temperatures are in the range from 55° C. to 58° C.

In parallel with the above temperature control there is performed an operation for setting the recording paper 8 onto the drum 7. Though not shown, a recording paper feed tray is set to the printer, and sheets of recording paper 8 are conveyed one by one from the tray to the drum 7. Each sheet of the recording paper 8 thus conveyed is clamped at its head side in the feed direction by means of the clampets 9. Thereafter, the drum 7 with the recording paper 8 wound thereon rotates in the arrow C direction up to the recording start position and then stops.

This stop position is a position (the position illustrated in FIG. 2B) where the position of the intermediate transfer roller 1 with an image of the head line in a page to be written therein is set so as to correspond to the head line of the recording paper 8 at the time of retransfer.

The stop at the recording start position is made by detecting the detection piece 12 of the detection plate 11 through the sensor 13, the detection plate 11, which is disc-like, being mounted coaxially with the drum 7 and adapted to rotate with rotation of the drum.

More specifically, as shown in FIG. 3, the sensor 13 first senses, using the sensor detecting position 13A, a side 12A of the detection piece 12 rotating together with the drum 7 which side is the foremost part in the rotating direction of the drum 7, whereupon the sensor 13 itself turns on and causes the drive motor for the drum 7 to turn off, acting to stop the drum 7 completely. Until complete stop of the drum 7 there is generated a sensor interrupt by the sensor control section 23 of the recording start control means 22 in the printer.

During the period from when the sensor 13 has turned on until complete stop of the drum 7, the detection plate 11 advances by a distance a in FIG. 3. This distance a corresponds to a recording dislocation which occurs at the time of recording and which is to be corrected by the present invention. At a maximum value the distance a assumes a resolution value of the drive system, that is, it becomes equal to the moving distance in the vertical scanning direction of the recording medium when the drive motor (not shown) for the drum 7 rotates one step.

The time required for advancing the distance a is detected in terms of the number of times the foregoing interrupt processing is generated by the sensor 13. More specifically, if the interrupt of the sensor 13 is generated n times until complete stop of the drum 7, then given that the sensor interrupt time interval is t1, the time required for advancing the distance a is n×t1.

The time required for advancing the distance a is stored as the recording start correction data in the data storage section 24 in the recording start control means 22 in the printer.

The time required for advancing the distance a can be detected, for example, by starting a timer upon turning on of the sensor 13 and stopping it upon complete stop of the drum 7.

Description will now be directed below to a recording process after completion of the foregoing recording operation stand-by state.

First, the ink ribbon 5 is wound up until a predetermined color can be fed for recording.

The ink ribbon used in this embodiment is a color ribbon having four colors of Y, M, C and Bk which are formed in the longitudinal direction of the ribbon successively and repeatedly. Since the recording order is Y→M→C→Bk, the ink ribbon 5 is taken up so that the head position of the ink color Y becomes opposed to the upper surface of the recording head. The discrimination of ink colors is made by recognizing a marker printed between adjacent colors of the ink ribbon 5 with use of a photosensor or the like (not shown).

In the case of using a monocolor ink ribbon, there inevitably is no need for ink discrimination, so the conveyance of the ink ribbon 5 up to the head position of the next ink color is basically omitted, but as the case may be the ink ribbon 5 is taken up slightly for eliminating the looseness of the ribbon.

Next, the thermal head 3 is moved in the direction of arrow D in FIG. 1 and is brought into pressure contact with the intermediate transfer roller 1 with the ink ribbon 5 therebetween. At the same time the drum 7 is also moved in the arrow E direction and is also brought into contact with the roller 1.

At this time, the contact pressure of the thermal head is preferably in the range of 100 to 300 g/cm, and in this embodiment it is set at 200 g/cm.

The contact pressure of the drum is preferably in the range of 1 to 10 kg/cm, and in this embodiment there is adopted a drum contact pressure of 5 kg/cm.

After completion of the above pressure contact, the intermediate transfer roller 1 is rotated by means of the motor (not shown), and the resulting frictional force is utilized to convey the ink ribbon 5. The drum 7 is also rotated by virtue of the frictional force developed between the drum and the intermediate transfer roller 1 through the recording paper 8 or the frictional force created directly on the drum.

During the recording operation, the ink ribbon 5 is taken up independently by means of a motor (not shown). The take-up speed is set always higher than the speed of conveyance based on the frictional force between the ink ribbon and the intermediate transfer roller 1, and the difference between both speeds is adjusted by means of a slip mechanism in the take-up portion, whereby the ink ribbon 5 after completion of the ink transfer is kept stretched without becoming loose.

In parallel with the above rotating motion, predetermined pulse signals to be recorded are applied to the thermal head 3 to cause the heating elements to generate heat, so that the ink of the ink ribbon 5 thus heated by each heating element melts and is transferred onto the intermediate transfer roller 1.

When each predetermined pulse signal is applied to the thermal head 3, correction is made to shift the recording timing by the recording start correction data stored in the data storage section 24. In more particular terms, the recording start control section 25 in the recording start control means 22 controls the recording timing in such a manner that predetermined pulse signals are applied to the thermal head of the printer drive section 26 while shifting the recording timing by the time n×t1 required for advancing the distance a of the drum 7 from the time the sensor 13 turns on until when the drum 7 stops completely, to start recording. By making correction based on the latest recording start correction data for each color, the initial recording position can be kept constant in a single recording process and hence it is possible to overcome the problem of recording dislocation.

Moreover, since the value of n×t1 obtained can be operated and changed arbitrarily on the software of the recording start control means 22 in the printer, it is possible to make correction using arbitrary values if necessary. For example, the recording dislocation correction value can be changed for each color. Besides, no limitation is placed on the number of colors. Further, the recording start control means 22 may be disposed in the printer body or it may be disposed in the body of a computer, a word processor, or the like, connected to the printer.

Ink portions 14 having been melted and transferred onto the intermediate transfer roller 1 move rotatively while maintaining its melted or half-melted state on the roller 1 with the heat of the same roller.

The ink portions 14 thus in a melted or half-melted state is retransferred onto the recording paper 8 by virtue of the contact pressure force between the intermediate transfer roller 1 and the drum 7 and the effect of heating and heat retention induced by both roller 1 and drum 7.

According to this embodiment, the subsequent recording using M, C and Bk inks is performed while maintaining, not cancelling, the state of pressure contact between the intermediate transfer roller 1 and the drum 7 and the pressure contact state between the roller 1 and the thermal head 3 through the ink ribbon 5.

This is because the ribbon length of each color is defined so that, after the end of recording in Y, the head position of the next color (M, C, Bk) of the ink ribbon 5 arrives at the portion of the thermal head 3. Consequently, the cancellation of the pressure contact state of the thermal head 3 and the conveyance of the ink ribbon 5 up to the ink head position need not be performed even at every termination of recording in each color. Directly, while a pulse signal based on recording information of each color is applied to the thermal head 3, the transfer of ink to the intermediate transfer roller 1 and retransfer of ink to the recording paper 8 can be repeated continuously for the four colors.

After completion of the recording in Y, M, C and Bk, the thermal head 3 and the drum 7 are released from their pressure contact state in the directions of arrows A and B, respectively.

Subsequently, the recording paper 8 having been recorded is moved away from the drum 7 and is discharged.

The above is the recording process in the printer illustrated in FIG. 1.

Although in this embodiment the recording in four colors is performed in a continuous manner, the recording may be conducted in the same manner as in the conventional printer wherein the recording is carried out while including a process between adjacent color recording operations which process comprises detecting the head position of each color of the ink ribbon 5, performing a pressure contact of the intermediate transfer roller 1 and the thermal head 3 and that of the roller 1 and the drum 7 to effect recording (retransfer) and subsequent releasing of the pressure contact state.

The recording in the above embodiment was assumed to be a color recording, in which the fed recording paper 8 is wound up onto the drum 7 and clamped for fixing with the clampers 9 mounted on the drum 7. However, in the case of a monochromatic recording, for example in the case of using Bk ink, the recording paper 8 may be discharged as it is simultaneously with the retransfer and therefore it is not always necessary to clamp the recording paper.

Thus, according to the printer and recording start control method of this embodiment, the recording dislocation can be corrected without replacement of components in the printer drive system. For example, even if the drive motor speed is set lower than in the prior art, the recording dislocation can be corrected with an accuracy equal to or even higher than that in the prior art. This is advantageous in point of both current consumption of the drive motor and noise.

Moreover, since the heat generation timing of the heating elements of the thermal head is controlled by software, it is possible to effect an accurate correction; besides, the value of correction data can be set arbitrarily according to situations.

Figure 5:
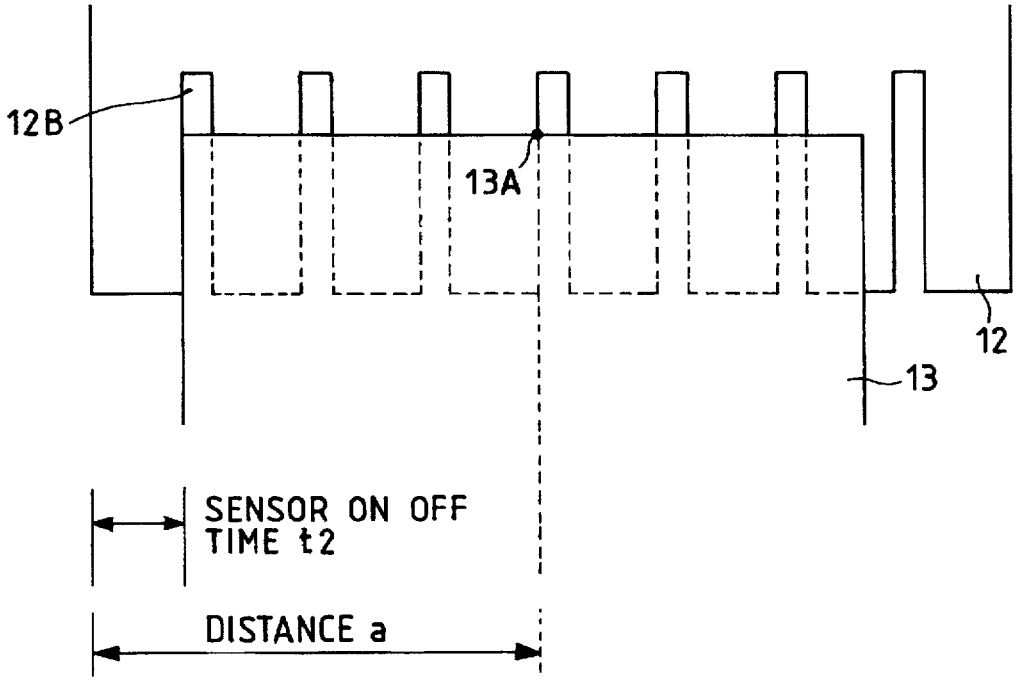
FIG. 5 is an explanatory diagram showing a positional relation between a sensor and a detection piece at the time of detection of correction data in a second embodiment of the present invention.

FIG. 5 is an explanatory diagram showing a printer according to a second embodiment of the present invention. The printer of this embodiment has a detection plate of a construction different from that of the printer of the first embodiment described above. With respect to the printer and recording start control method for the printer according to this embodiment, reference will be made below to only different portions from the printer of the first embodiment.

In the printer of this embodiment, a plurality of slits 12B each longer than the overlapped length with the sensor 13 are formed in the shape of a comb at the front-end side of the detection piece 12 which serves as a detection part of the sensor, the slits 12B being formed at predetermined intervals.

From the time the sensor 13 senses the front-end side of the detection piece 12 in the rotating direction of the detection plate 11 and thereby turns on until when the drum 7 stops completely, the detection plate 11 advances by a distance a in FIG. 5. The distance a, at a maximum value thereof, assumes a resolution value of the drive system, that is, it becomes equal to the moving distance in the vertical scanning direction of the recording medium when the drive motor (not shown) has rotated one step.

The time required for the detection plate 11 to advance the distance a can be determined on the basis of how many times the sensor 13 has turned on and off through the slits 12B of the detection piece 12. Given that the number of on-off times of the sensor 13 is m and a single on-off time of the sensor 13 is t2, the time required for moving the distance a is m×t2, with t2 being determined uniquely from the speed of the drive motor.

The time required for moving the distance a is stored in memory and is later used as recording start correction data at the start of recording.

The subsequent recording process and effects obtained are the same as in the previous embodiment, description thereof is here omitted.

Figure 6:
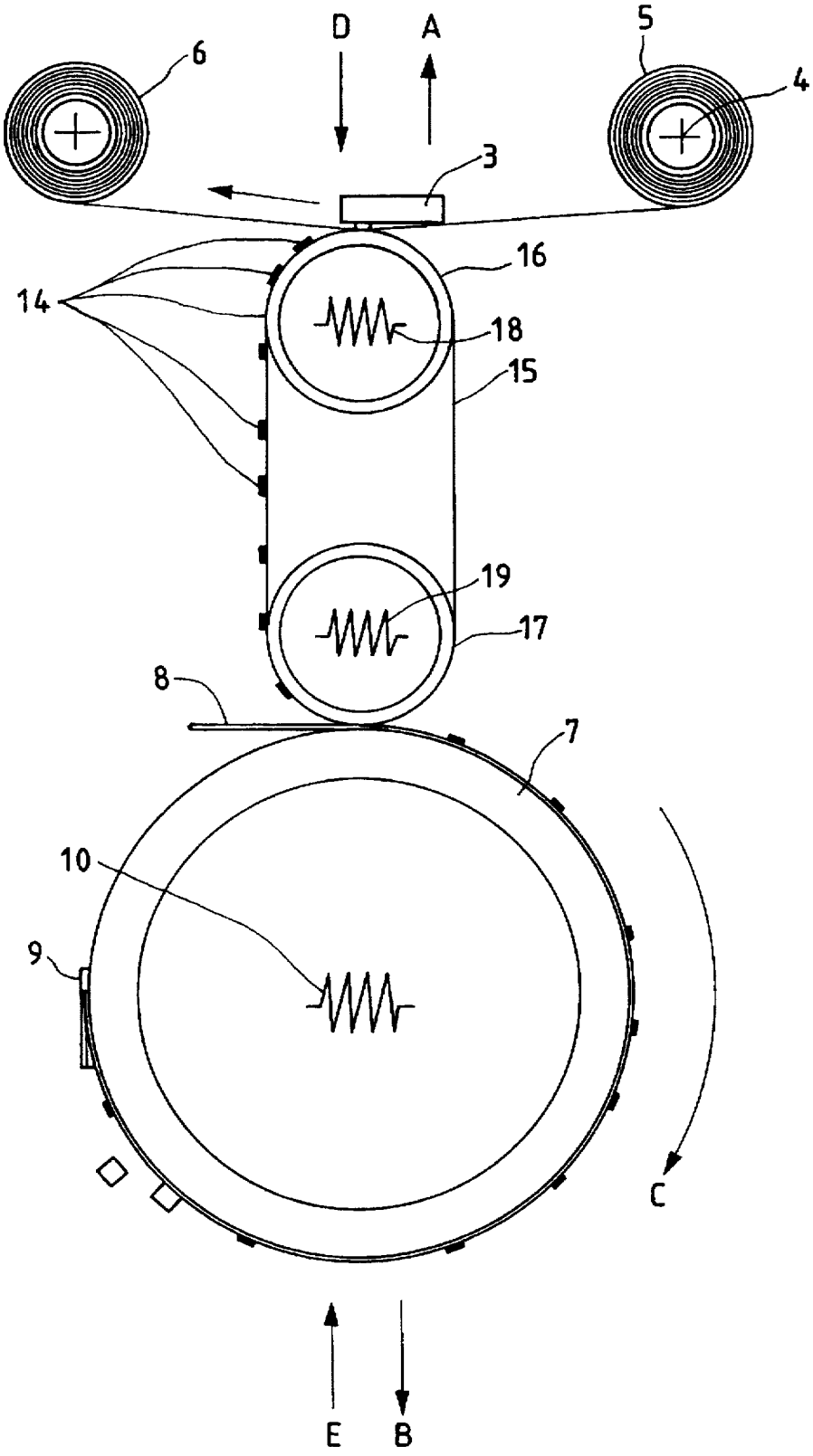
FIG. 6 is a sectional view showing a partial construction of a printer according to a third embodiment of the present invention.

FIG. 6 is a sectional view showing a partial construction of a printer according to a third embodiment of the present invention, in which the same portions as in the first embodiment are indicated by the same reference numerals as in the first embodiment.

The third embodiment is the same in basic recording principle as the first embodiment, but the difference in construction between the two resides in that the intermediate transfer roller 1 shown in FIG. 1 is substituted in FIG. 6 by an intermediate transfer belt 15, the roller 15 being rotated under tension created by both platen roller 16 and backup roller 17. Reference will be made below to only constructional portions different from the construction of the first embodiment.

In this third embodiment, the cylindrical platen roller 16 is disposed in an opposed relation to the heating elements of the thermal head 3 through the ink ribbon 5. Within the platen roller 16 is disposed a heater 18 for heating the platen roller. Further, for pressure contact between the intermediate transfer belt 15 and the paper 8, the cylindrical backup roller 17 is disposed in an opposed relation through the paper 8 to the drum 7 which can move in the arrow C direction. Inside the backup roller 17 is disposed a heater 19 for heating the backup roller. Also inside the drum 7 is disposed the heater 10 for heating the drum to a predetermined temperature, like the previous embodiments. The intermediate transfer belt 15 is entrained in a stretched state on the outer periphery of the platen roller 16 and that of the backup roller 17. Thus, both intermediate transfer belt 15 and paper 8 are interposed between the drum 7 and the backup roller 17.

The intermediate transfer belt 15 is preferably a seamless belt, but even a belt having a seam is employable if it is used while avoiding transfer and retransfer of ink at the seam portion. The belt used in this embodiment is a 50 μm thick seamless belt of polyimide. The surface of the intermediate transfer belt 15 is coated with an intermediate transfer material. The intermediate transfer material suffices provided it has a smooth surface and can primarily hold a primary recorded image formed by an ink layer; for example, it may be a rubber sheet, a plastic sheet, a metallic sheet, or a combination thereof. In this embodiment a 150 μm thick coating rubber layer for transfer and retransfer is used as the intermediate transfer material.

In the printer of this embodiment the function of the platen roller 16 and that of the pressure roller 17 are independent of each other. The platen roller 16 has a construction and set temperature suitable for the transfer of ink to the intermediate transfer belt 15, while the pressure roller 17 has a construction and set temperature suitable for the retransfer of the ink 14 to the recording paper 8.

In this embodiment the platen roller 16 has an aluminum core and has an outside diameter of 16 mm, with silicone rubber being formed on its outer periphery to a thickness of 1 mm. Inside the platen roller 16 is mounted a halogen lamp with a dissipation of 200 W as the heater 18 to make temperature control so that the surface temperature of the intermediate transfer belt 15 in contact with the platen roller 16 is 40° C.

The pressure roller 17 has an aluminum core and has an outside diameter of 42 mm, with silicone rubber formed on the outer periphery thereof to a thickness of 0.5 mm. Inside the pressure roller 17 is mounted a halogen lamp with a dissipation power of 200 W as the heater 19 to control the surface temperature of the intermediate transfer belt 15 on the pressure roller 17 to 65° C.

In the third embodiment, as set forth above, the constructions of and temperature control for the transfer portion and the retransfer portion can be set each independently to optimal conditions.

Other constructional points are the same as in the first embodiment; for example, the detection plate 11 adapted to rotate with rotation of the drum 7 is attached to the drum 7 which is disposed for pressure contact with the pressure roller 17 through the intermediate transfer roller 15 and the recording paper 8, and the sensor 13 for sensing the detection piece 12 integral with the detection plate 11 is mounted in the printer body which is a housing. As mentioned previously, therefore, the detection plate 11 is detected by the sensor 13 to obtain recording start correction data, which data is then stored in the recording start control means 22 in the printer, and in the subsequent recording operation process there is made correction to shift the heat generation timing of the thermal head 3 on the basis of the recording start correction data, whereby the recording dislocation can be prevented as in the previous embodiments.

Figure 7:
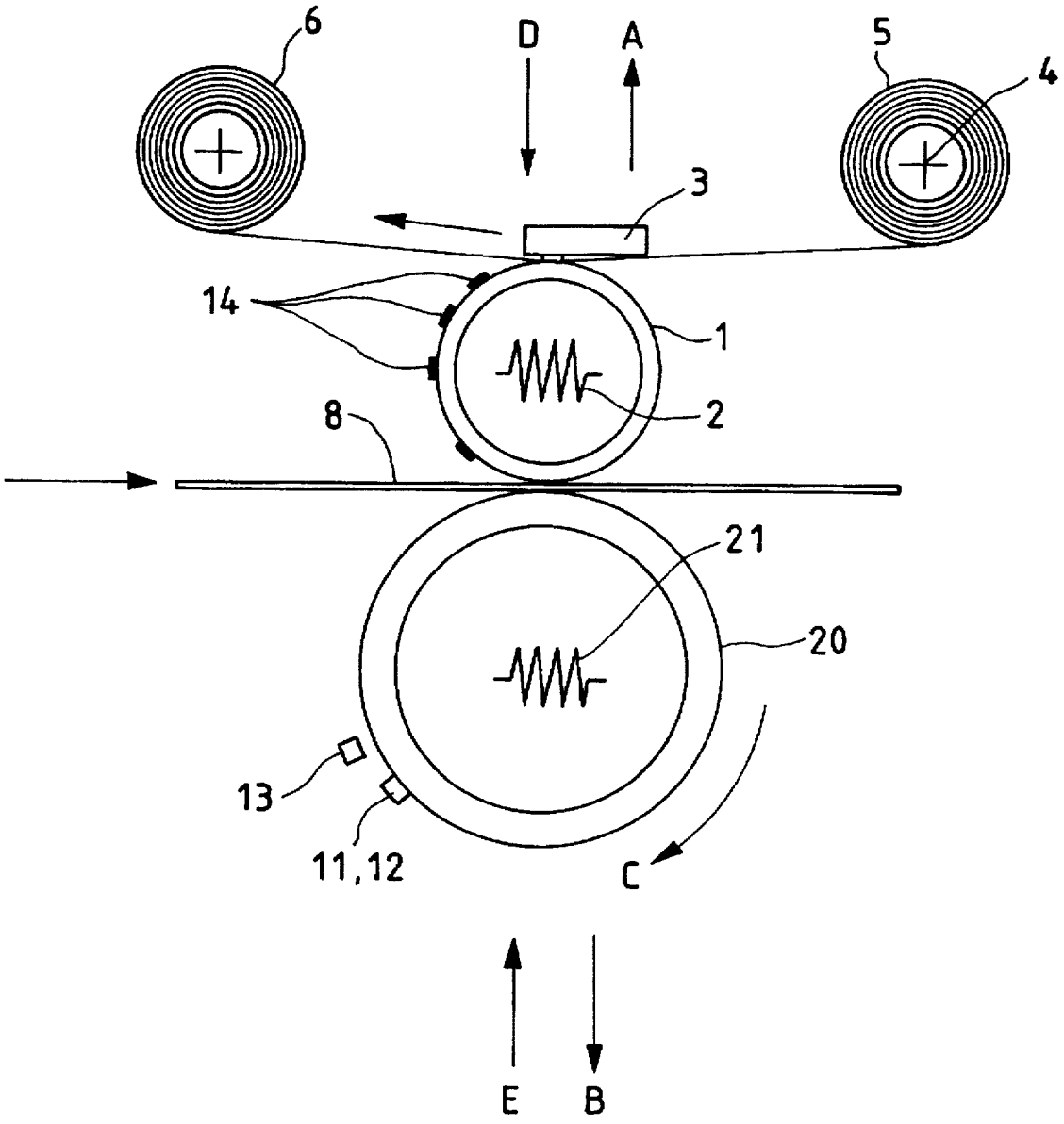
FIG. 7 is a sectional view showing a partial construction of a printer according to a fourth embodiment of the present invention.

FIG. 7 is a sectional view showing a partial construction of a printer according to a fourth embodiment of the present invention, in which the same portions as in the first embodiment are indicated by the same reference numerals as in the first embodiment.

The basis recording principle of this fourth embodiment is the same as in the first embodiment, with a difference in construction between the two residing in that the drum 7 in FIG. 1 is substituted by a pressure roller 20 in FIG. 7. Description will be directed below to only different constructional portions from the construction of the first embodiment.

At the time of retransfer of ink to the recording paper 8, the pressure roller 20 comes into pressure contact with the intermediate transfer roller 1 to heat the recording paper 8 only at the pressure contact portion. Also inside the pressure roller 20 used in this embodiment is disposed a heater 21 capable of producing heat in an amount which permits improvement in the retransfer performance of the ink 14 with respect to the recording paper 8.

In the previous first embodiment the detection plate 11 is mounted coaxially with the drum 7, while in this fourth embodiment it is mounted coaxially with the pressure roller 20 on one side in the extending direction of the pressure roller.

According to the recording process in the intermediate transfer type printer of this embodiment, such a four-color recording as in the first embodiment cannot be done continuously at a time. In the printer of this embodiment, recording is performed by what is called a swing back method wherein a series of steps is carried out after the end of recording and before the start of the next recording, the said series of steps comprising releasing the pressure contact state of the thermal head 3 after recording in one color, then setting the head position of the next color of the ink ribbon 5 or conveying the ink ribbon 5 for creating tension, and simultaneous reverse-conveying the recording paper 8 up to the initial stand-by position.

Thus, according to this embodiment, even with a difference in the recording process, the detection plate 11 is detected by the sensor 13 to obtain recording start correction data, the data thus obtained is stored in the recording start control means 22 in the printer, and in the subsequent recording process, on the basis of the recording start correction data there is made correction of shifting the recording timing in energizing the heating elements of the thermal head 3, whereby it is possible to prevent recording dislocation.

Figure 8:
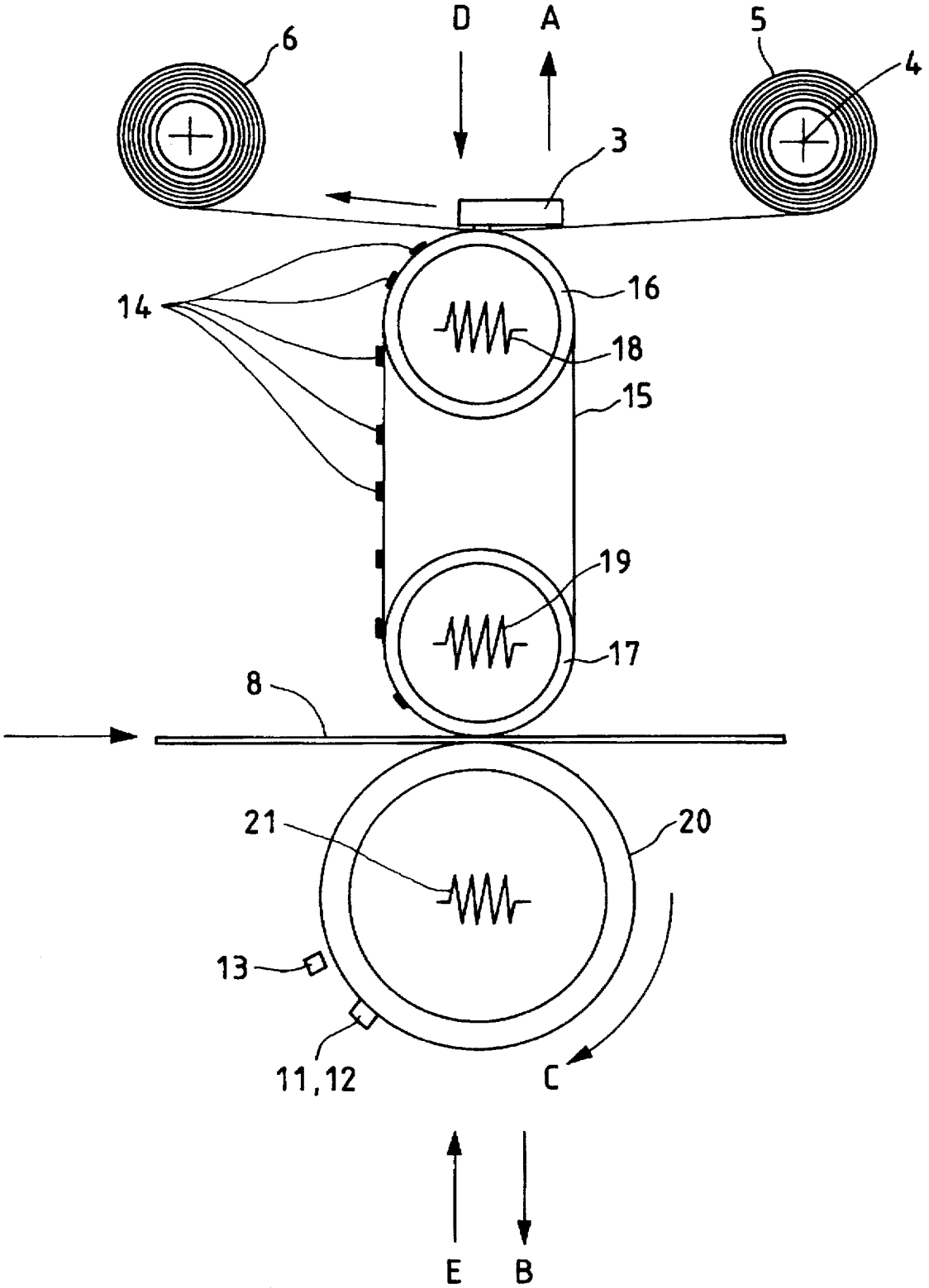
FIG. 8 is a sectional view showing a partial construction of a printer according to a fifth embodiment of the present invention.

FIG. 8 illustrates a printer according to a fifth embodiment of the present invention, which printer is a combined printer of the printers of the third and fourth embodiments described above. According to this combined printer, the foregoing swing back type recording process is carried out while using both intermediate transfer belt 15 in the third embodiment and pressure roller 20 in the fourth embodiment.

More specifically, in the printer of this embodiment, the cylindrical platen roller 16 is disposed in an opposed relation to the heating elements of the thermal head 3 through the ink ribbon 5. Within the platen roller 16 is disposed the heater 18 for heating the platen roller. Further, for pressure contact of the intermediate transfer belt 15 and the recording paper 8, the cylindrical backup roller 17 is disposed opposedly through the recording paper to the pressure roller 20 which can move in the arrow C direction. Inside the backup roller 17 is disposed the heater 19 for heating the backup roller. The intermediate transfer belt 15 is wound in a stretched state on the outer periphery of the platen roller 16 and that of the backup roller 17. Thus, both intermediate transfer belt 15 and recording paper 8 are interposed between the pressure roller 20 and the backup roller 17.

Also inside the pressure roller 20 is disposed the heater 21 for heating the pressure contact portion of the recording paper 8. This is the same as in the preceding embodiment.

Moreover, like the preceding embodiment, the detection plate 11 adapted to rotate with rotation of the pressure roller 20 is attached to the same pressure roller 20 which is disposed for pressure contact with the backup roller 17 through both intermediate transfer belt 15 and recording paper 8, and the sensor 13 for sensing the detection piece 12 integral with the detection plate 11 is mounted in the printer body which is a housing. Therefore, by making correction to shift the heat generation timing of the thermal head 3 in the same manner as in the preceding example it is made possible to prevent recording dislocation as in the preceding embodiment.

Although the outside diameter of the pressure roller 20 used in the above fourth and fifth embodiments is not described in detail, if it is relatively small, the pressure roller 20 is required to rotate plural times for obtaining a single-color recording for the recording paper 8 and hence the sensor 13 also senses the detection plate 11 plural times. In this case, control is made so as to perform single recording correction for plural detections of the detection plate 11. How many times the detection plate 11 is to be detected is set arbitrarily according to the length of the recording paper 8 and the outside diameter of the pressure roller 20.

For example, if the pressure roller 20 rotates three times for obtaining a single-color recording for a single recording sheet of paper 8, then control is made so that the correction data is obtained upon third detection of the detection plate 11 by the sensor 13.

In the case where the outside diameter of the pressure roller 20 is large like the drum 7 for example, control may be made so as to obtain the correction data at every detection of the detection plate 11 by the sensor 13.

Although in all of the above five embodiments there is performed recording on only one side of the recording medium, it goes without saying that a both-side recording can also be attained by repeating twice any of the processes in those embodiments for the surface and back of the recording medium. As to the recording paper conveying means in such both-side recording, various means are conceivable.

Reference will be made below briefly to both-side printing methods.

According to a first method for controlling the start of both-side recording, recording is made for one side (surface)

of the recording paper 8, then after discharge of the recording paper, the user inverts the recorded side of the paper and then sets the paper into the paper feed tray to effect both-side recording.

According to a second method, sheets of recording paper each once recorded on the surface thereof and then discharged are stored in a paper discharge stacker. The paper discharge stacker can be mounted as a paper feed tray and is constructed so that the user can turn the stacker upside down and then use it as a paper feed tray. By mounting the paper discharge stacker as a paper feed tray so that the recording surface of the recording paper is on the back side, it is possible to effect both-side recording.

According to a third method, the recording paper conveyance in both-side recording is performed wholly within the printer. The recording paper 8 once recorded on its surface is not discharged but is temporarily stored in a stacker for storage formed in the conveyance route within the printer. Thereafter, the recording paper passes through the conveyance route from the stacker for storage in such a manner that its recording surface is positioned on the back side. Then, after recording of the back side, the paper passes through the discharge route and is discharged onto the discharge stacker.

The present invention is not limited to the foregoing embodiments, but various modifications may be made if necessary.

For example, although the descriptions of the foregoing embodiments refer to an intermediate transfer type printer, the present invention is not limited to an intermediate transfer type printer or a printer using an ink ribbon, but is also applicable to any other printer if only it has a sensor and a mechanism corresponding to a detection plate to be on-off detected by the sensor. For example, the present invention is applicable also to an ink jet type printer.

Although in the printers of the third embodiment and the embodiments which follow there has been made no special reference to the construction of the detection piece of the detection plate, it goes without saying that the same functions and effects as above will be obtained no matter which of the detection pieces explained in the first and second embodiments, respectively, may be used.

As set forth above, the printer and the recording start control method for the printer both according to the present invention make correction of recording dislocation on the basis of printing start correction data. According to the present invention, it is possible to prevent recording dislocation and obtain good recorded information without any cost for great modifications or changes of hardware.

That is, since the recording start control means is provided, it is possible to prepare printing start correction data and correct the operation timing of the recording thermal head on the basis of the data. Even if the speed of the drive motor is set lower than that in the prior art, it is possible to correct recording dislocation with an accuracy equal to or even higher than that in the prior art. This is advantageous in point of dissipation power and noise of the drive motor. Further, since the printing start correction data can be differently set arbitrarily, it is possible to cope with various recordings.

What is claimed is:

1. A printer in which a recording medium holding mechanism is intermittently rotated by a stepping motor, and recording is performed a plurality times on a recording medium mounted on said recording medium holding mechanism in each rotational position of said recording medium holding mechanism by a recording head, said printer comprising:

a sensor for generating a detection signal when said recording medium holding mechanism is rotated into a predetermined rotational position;

position control means for turning off said stepping motor in response to said detection signal generated by said sensor; and recording start control means including a sensor control section for calculating a time period between the generation of said detection signal and complete stop of said stepping motor, said recording start control means controlling recording performed by said recording head in accordance with the calculated time period such that recording is aligned on the recording medium relative to the predetermined rotational position, wherein said sensor control section generates interrupt signals at predetermined time intervals during the time period, and calculates the time period by counting the number of interrupt signals generated during the time period.

2. A printer according to claim 1, further comprising a detection plate which is detected by said sensor when said recording medium holding mechanism is in a predetermined rotational position.

3. A printer according to claim 2, wherein said detection plate has a detection portion formed in the shape of comb-like slits for detection by said sensor.

4. A recording start control method for a printer in which a recording medium holding mechanism is driven intermittently one rotation at a time a stepping motor and recording is performed a plurality of times in one position of a recording medium on said recording medium holding mechanism by a recording head, said method comprising:

detecting a start time when said recording medium holding mechanism is rotated into a predetermined rotational position;

turning off said stepping motor at the start time;

generating interrupt signals at a predetermined time frequency;

counting a number of said interrupt signals generated between said start time and a time when said stepping motor stops rotating;

storing the number of interrupt signals as recording start correction data; and at the time of actual recording, controlling the operation timing of the recording head in accordance with said recording start correction data such that recording is aligned on the recording medium relative to the predetermined rotational position.

* * * * *